US010435630B2

(12) United States Patent
Blackburn

(10) Patent No.: US 10,435,630 B2
(45) Date of Patent: Oct. 8, 2019

(54) METHOD FOR REDUCING MUTAGENICITY IN PETROLEUM AROMATIC EXTRACTS

(71) Applicant: Gary Blackburn, Newtown, PA (US)

(72) Inventor: Gary Blackburn, Newtown, PA (US)

( * ) Notice: Subject to any disclaimer, the term of this patent is extended or adjusted under 35 U.S.C. 154(b) by 347 days.

(21) Appl. No.: 15/424,885

(22) Filed: Feb. 5, 2017

(65) Prior Publication Data

US 2017/0226428 A1 Aug. 10, 2017

Related U.S. Application Data

(60) Provisional application No. 62/292,291, filed on Feb. 6, 2016.

(51) Int. Cl.

| | |
|---|---|
| ***C10G 21/00*** | (2006.01) |
| ***C10G 21/12*** | (2006.01) |
| ***C10G 21/20*** | (2006.01) |
| ***C10G 21/28*** | (2006.01) |
| ***C10G 67/04*** | (2006.01) |

(52) U.S. Cl.

CPC ..... *C10G 21/00* (2013.01); *C10G 21/28* (2013.01); *C10G 67/04* (2013.01); *C10G 2300/44* (2013.01); *C10G 2400/30* (2013.01)

(58) Field of Classification Search

CPC ..... C10G 21/00; C10G 21/12; C10G 21/16; C10G 21/20; C10G 21/28; C10G 2300/44; C10G 2400/30; C10G 67/04

See application file for complete search history.

(56) References Cited

U.S. PATENT DOCUMENTS

| | | | | |
|---|---|---|---|---|
| 2,096,950 | A | 10/1937 | Wilson | |
| 2,220,016 | A | 10/1940 | Lyons | |
| 2,417,355 | A | 3/1947 | Dummett et al. | |
| 2,449,610 | A | 9/1948 | Long | |
| 3,003,945 | A | 10/1961 | Garwin | |
| 3,052,620 | A | 9/1962 | Hanson | |
| 5,488,193 | A | 1/1996 | Mackerer et al. | |
| 5,961,709 | A | 10/1999 | Hayner et al. | |
| 6,010,617 | A | 1/2000 | Mackerer et al. | |
| 9,371,495 | B2 * | 6/2016 | Hansen | C10G 45/44 |
| 2013/0035533 | A1 | 2/2013 | Hedhli et al. | |

* cited by examiner

*Primary Examiner* — Renee Robinson
*Assistant Examiner* — Derek N Mueller
(74) *Attorney, Agent, or Firm* — LaMorte & Associates, P.C.

(57) ABSTRACT

System and method for reducing mutagen levels contained within a volume of petroleum aromatic extracts. The petroleum aromatic extracts are mixed with at least one solvent. This produces a mixture. Once mixed, some of the petroleum aromatic extracts dissolve. Others settle in the mixture. The petroleum aromatic extracts that have settled on the mixture are removed from the mixture and are ready for use. The mixture is heated to evaporate the solvent from the mixture. The evaporated solvent can be recaptured and reused. The residuum of the mixture contains petroleum aromatic extracts that can be partially recovered using traditional hydroprocessing techniques.

18 Claims, 4 Drawing Sheets

METHOD FOR REDUCING MUTAGENICITY IN PETROLEUM AROMATIC EXTRACTS

RELATED APPLICATIONS

The applications claims the benefit if U.S. Provisional Application No. 62/292,291, filed Feb. 6, 2016.

BACKGROUND OF THE INVENTION

1. Field Of The Invention

In general, the present invention relates to systems and methods that are used to reduce the mutagenicity associated with aromatic extracts that are produced during the refinement of petroleum oils. More particularly, the present invention relates to processes that temporarily combine aromatic extracts with materials that separate, remove, and/or reduce mutagenic compounds from petroleum aromatic extracts.

2. Prior Art Description

In the distillation of certain petroleum oils, aromatic extracts are produced. Aromatic extracts are typically produced during the refining of lubricating oil basestocks and waxes. Aromatic extracts are solvent extracts of distillates or the residue (residuum) from a refinery vacuum tower. Aromatic extracts are complex, highly viscous liquids that contain predominately aromatic hydrocarbons covering the carbon number range of $C_{15}$ to $C_{50}$.

Aromatic extracts can be grouped into two subcategories, which are distillate aromatic extracts (DAEs) and residual aromatic extracts (RAEs), according to the class of lubricating oil feedstock from which they are derived. The aromatic extracts are used as blending components of heavy fuels and in the manufacture of rubber and plastic. Aromatic extracts are also used as feedstock for production of carbon black, petroleum pitches, and resins.

Aromatic extracts contain certain levels of known mutagenic compounds. For example, distillate aromatic compounds contain significant amounts of polycyclic aromatic compounds, which are known mutagens. As a consequence, the use of distillate aromatic extracts as extender oils has been prohibited in the European Union beginning in January of 2010. Residual aromatic extracts (RAEs) can still be used, but must meet certain regulatory specifications.

Mutagenicity is a primary safety concern with the use of petroleum oils. However, the amount of mutagenic compounds present in a petroleum oil being processed varies from lot to lot. Each processed lot must be tested for levels of mutagenic compounds prior to being released by the refinery. Lots that meet regulatory specifications can be released. Lots that do not meet the regulatory specifications cannot be released and must be reprocessed by the distillery or disposed of as toxic waste. The holding and reprocessing of aromatic extracts adds significantly to the costs associated with running a petroleum refinery.

A particular lot of aromatic extracts is said to meet regulatory specifications by passing a biological mutagenicity test. The most common such test utilizes a salmonella/microsomal activation mutagenesis assay and is commonly referred to as the Modified Ames Test, or ASTM Method E 1687. Such a test produces a mutagenicity index (MI) ranking for the aromatic extracts being tested. For use in the European Union, residual aromatic extracts must have mutagenicity indices (MIs) of less than 0.40 in this assay.

The production run of aromatic extracts cannot be released by the refinery until the test results are received. This requires that the aromatic extracts be stored at the refinery. Furthermore, production runs of aromatic extracts have a high failure rate. If a production run fails, the aromatic extracts must be further processed. This significantly increases the costs of production.

In the prior art, there are several processes used by refineries to isolate or reduce the level of mutagenic compounds in petroleum byproducts. Many of these processes require the material to be mixed with virgin stock and reprocessed. This greatly reduces the productivity of the refinery since material must pass through refinery equipment more than once. In other processes, compounds can be added to the petroleum by products that isolate or reduce the mutagenic compounds. For example, in U.S. Pat. No. 6,010,617 to Mackerer, the mutagenicity of coal tar derivatives are reduced by mixing the coal tar derivatives with an alkylation agent.

In the present invention, a simple ketone is used as one agent to reduce mutagenicity in aromatic extracts of petroleum oils. Simple ketones, such as acetone, have often been mixed with petroleum oils in refineries. However, the use of the ketone is for the purpose of thinning the petroleum oil so that it flows better through the piping of the refinery. Such prior art is exemplified in U.S. Pat. No. 2,220,016 to Lyons, U.S. Pat. No. 2,096,950 to Wilson, and U.S. Pat. No. 3,052,620 to Hanson. Although such prior art mixes acetone with the feedstock oil, the acetone is evaporated in the distillation tower of the refinery prior to the creation of the aromatic extracts.

A need therefore exists for a system and method of treating aromatic extracts at a refinery to reduce mutagenicity indices in production lots of residual aromatic extracts so that all such lots pass current safety standards. Moreover, a need also exists for a system and methodology that reduces the mutagenicity indices of distillate aromatic extracts to levels where those oils would be deemed safe according to current standards, therein allowing distillate aromatic extracts to be once again used as process oils. These needs are met by the present invention as described and claimed below.

SUMMARY OF THE INVENTION

The present invention is a system and method of reducing mutagen levels contained within a volume of petroleum aromatic extracts. The petroleum aromatic extracts are a byproduct of refining a petroleum oil. The petroleum aromatic extracts contain mutagenic compounds that provide the extracts with high mutagenicity indices when tested.

To reduce the levels of the mutagenic compounds, the petroleum aromatic extracts are mixed with at least one solvent. This produces a mixture. Once mixed, some of the petroleum aromatic extracts dissolve. Others settle in the mixture. The petroleum aromatic extracts that have settled on the mixture are removed from the mixture. The petroleum aromatic extracts removed from said mixture have a lower level of mutagenic compounds than was present in the original material.

The mixture is heated to evaporate the solvent from the mixture. The evaporated solvent can be recaptured and reused. The residuum of the mixture contains petroleum aromatic extracts that can be partially recovered using traditional hydroprocessing techniques.

BRIEF DESCRIPTION OF THE DRAWINGS

For a better understanding of the present invention, reference is made to the following description of an exemplary embodiment thereof, considered in conjunction with the accompanying drawing, in which.

DETAILED DESCRIPTION OF THE DRAWINGS

Although the present invention system and method can be embodied in many ways to accommodate the design layout of different refineries, only one embodiment has been selected for the purposes of illustration and discussion. The exemplary embodiment represents one of the best mode contemplated for the invention. However, the exemplary embodiment is merely exemplary and should not be considered a limitation when interpreting the scope of the claims.

Figure 1:
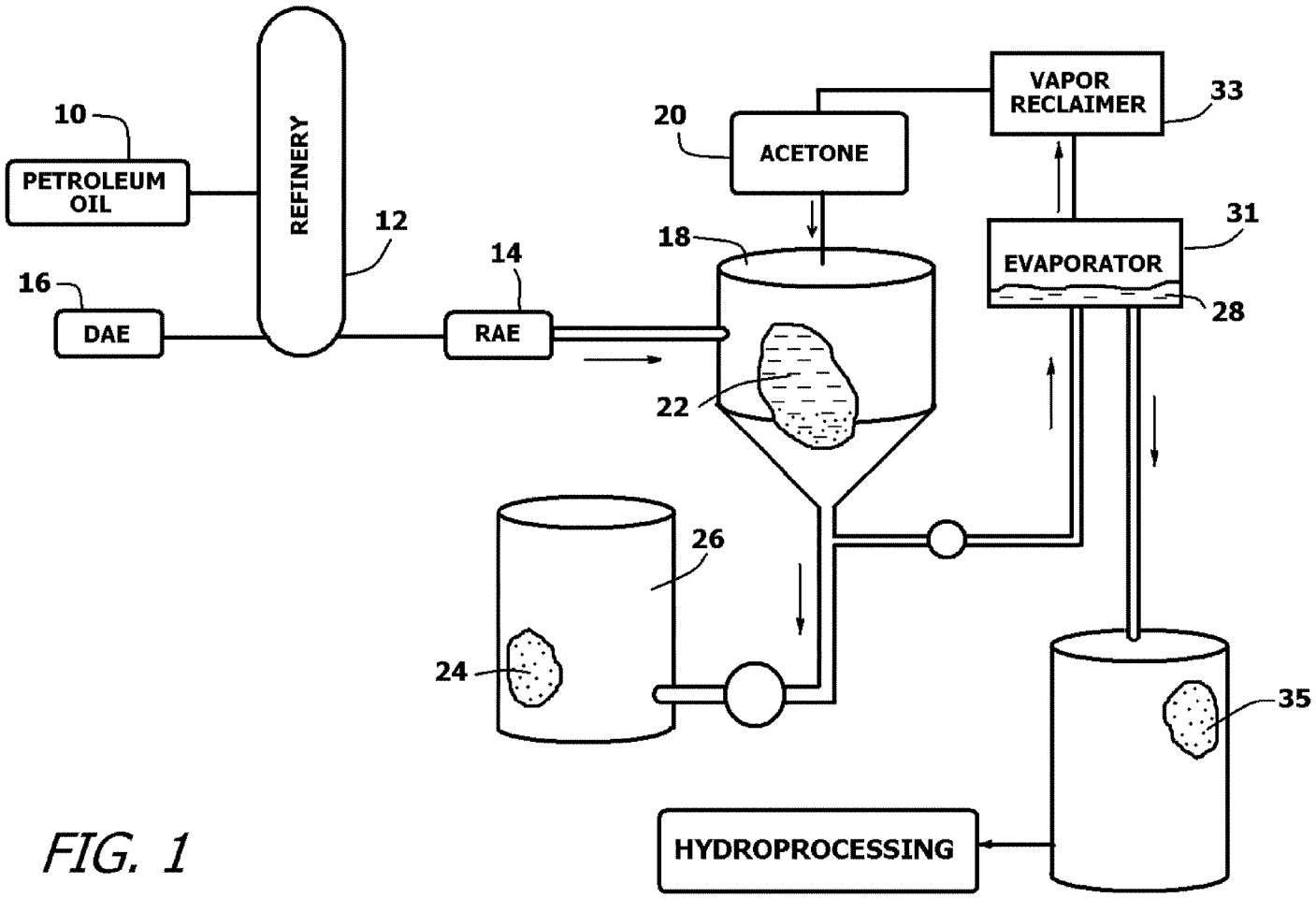
FIG. 1 is an exemplary schematic of the present invention system showing the processes utilized on residual aromatic extracts.

Referring to FIG. 1, the system and methodology is explained. A petroleum oil 10 is brought to a refinery 12 as feedstock and is refined in the traditional manner. During the refining process, various petroleum distillant products are produced. Among those products are aromatic extracts. The aromatic extracts include residual aromatic extracts (RAEs) 14 and distillate aromatic extracts (DAEs) 16. Both the RAEs 14 and the DAEs 16 contain mutagenic compounds at various levels. For the purposes of this disclosure, it is being assumed that the mutagenicity indices of both the RAEs 14 and the DAEs 16 are too high to be sold in a country with regulations on such matters. Consequently, it is desired to reduce the level of mutagenic compounds present in the RAEs 14 and DAEs 16.

Figure 2:
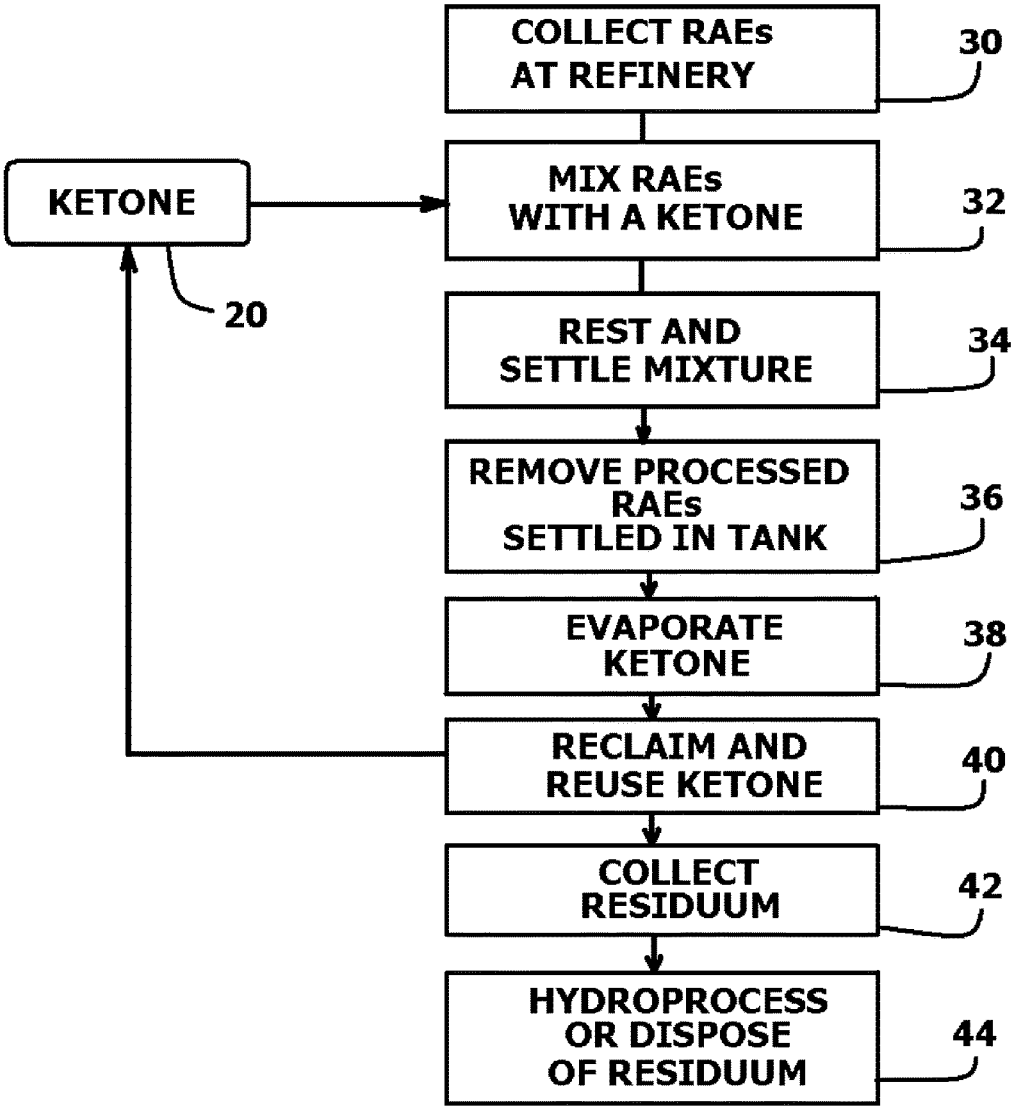
FIG. 2 is a block diagram showing the methodology of processing residual aromatic extracts.

Referring to FIG. 1 in conjunction with FIG. 2, the treatment of the RAEs 14 is first described. The RAEs are collected from the refinery 12 in the traditional manner. See Block 30. The RAEs 14 are then introduced into a mixing tank 18. Acetone 20, or a similar simple ketone, is introduced into the mixing tank 18 with the RAEs 14 in order to produce a mixture 22. See Block 32. The acetone 20 and RAEs 14 are mixed at a ratio of approximately five parts acetone 20 to one part RAEs 14, by volume. The RAEs 14 and acetone 20 are mixed for a period of time to achieve dissolution of any compounds that can be dissolved in the acetone 20 at the operating temperature and pressure. The mixture 22 is then brought to rest and its contents are allowed to settle. See Block 34.

The primary mutagenic compounds within the RAEs 14 are polycyclic aromatic hydrocarbons. Depending upon the cyclic species of the polycyclic aromatic hydrocarbons present, the acetone 20 either dissolves the polycyclic aromatic hydrocarbons or acts to alter the polycyclic aromatic hydrocarbons, therein altering their mutagenicity. As the mixture 22 settles, much of the RAEs 14 separate from the acetone 20. The settled RAEs are herein referred to as raffinate or processed RAEs 24. The processed RAEs 24 settle to the bottom of the mixing tank 18 and are removed to a storage tank 26. See Block 36. The processed RAEs 24 in the storage tank 26 have mutagenicity indices below the regulatory rejection threshold. The processed RAEs 22, therefore, and are safe and ready for sale in any regulated market.

The remaining solution 28 becomes isolated in the mixing tank 18. The remaining solution 28 is then heated to a temperature that is above the boiling point of the acetone 20 but well below the boiling point of the dissolved RAEs 14. See Block 38. This can be done by heating the mixing tank 18. However, in the illustrated system, the remaining solution 28 is pumped through an evaporator 31. The acetone 20 vaporizes and is reclaimed using a vapor reclaimer 33. The reclaimed acetone 20 is reused in subsequent runs. See Block 40.

As the acetone 20 is removed from the remaining solution 28, a residuum 35 of precipitated RAEs remain. The residuum 35 is collected and processed using traditional refinery hydroprocessing techniques. See Block 42 and Block 44. After hydroprocessing, many of the RAEs from the residuum 35 are recovered and can be mixed with the processed RAEs 24. It will be understood that the step of reworking the residuum 35 with hydroprocessing is optional and depends upon the volume of residuum 35 produced in a production run.

Figure 3:
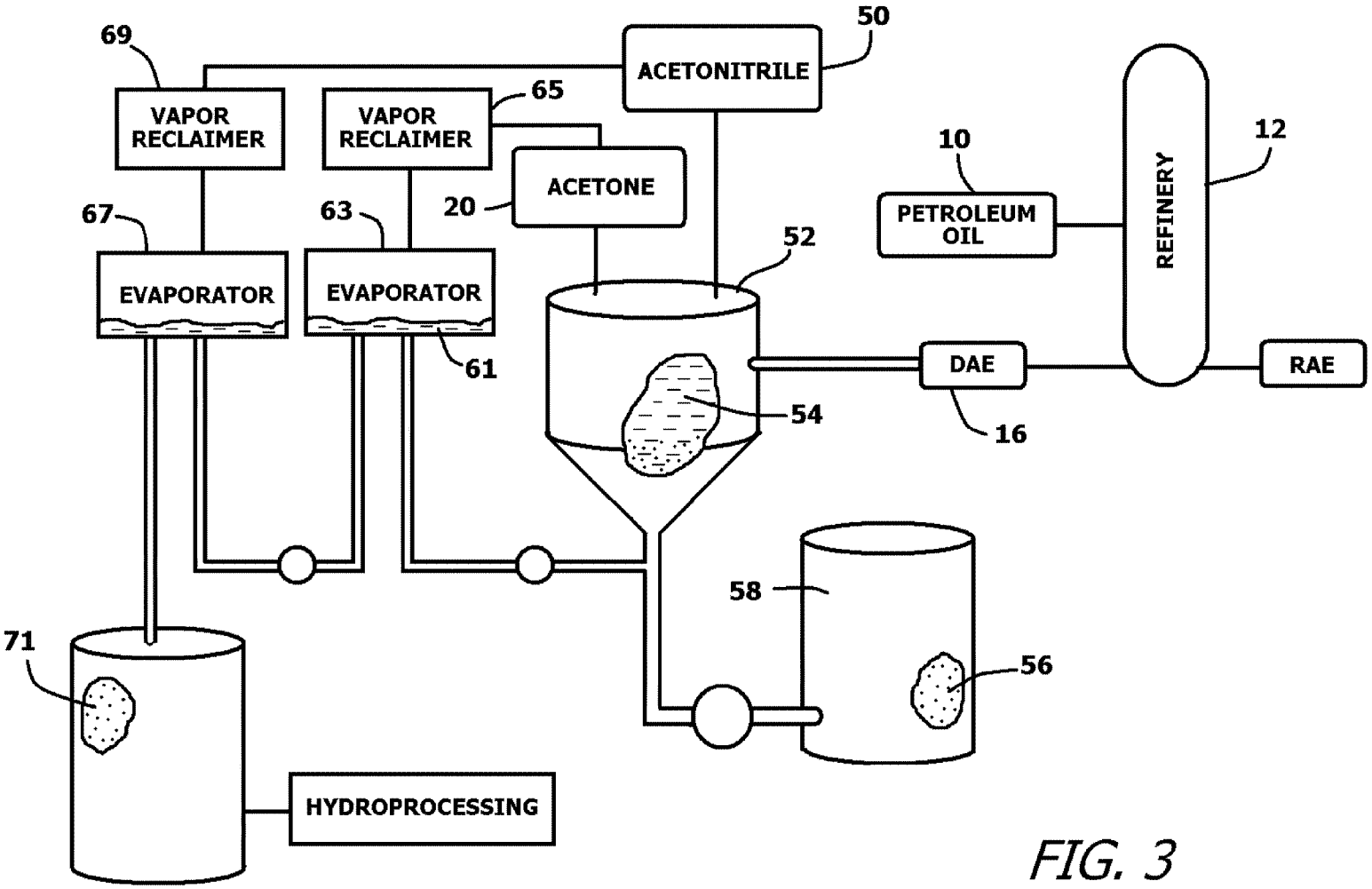
FIG. 3 is an exemplary schematic of the present invention system showing the processes utilized on distillate aromatic extracts.
Figure 4:
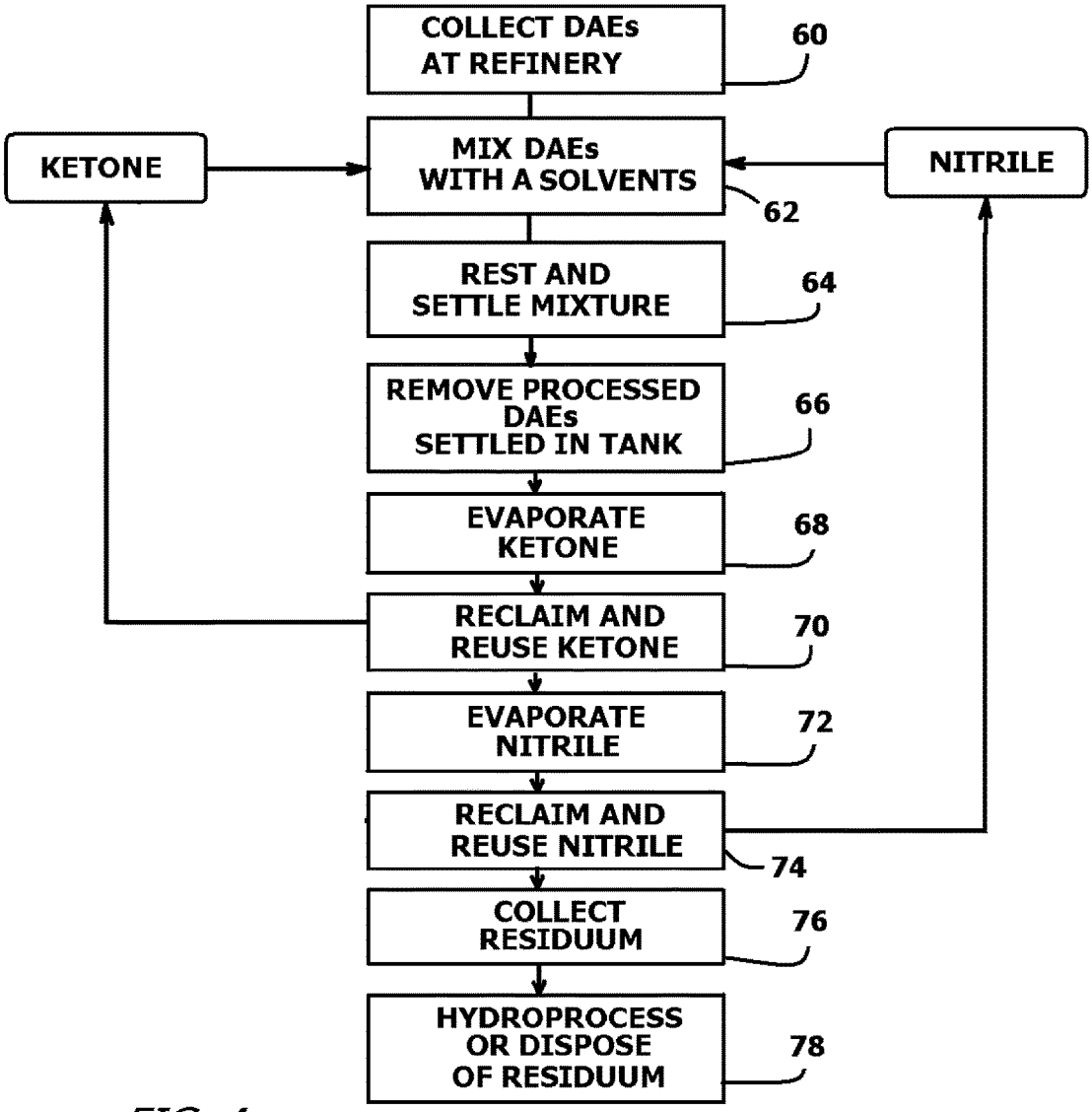
FIG. 4 is a block diagram showing the methodology of processing distillate aromatic extracts.

Referring to FIG. 3 in conjunction with FIG. 4, the treatment of the DAEs 16 is described. Under current regulations, DAEs have been banned for use as extender oils for petroleum products in the European Union. This is primarily due to the high mutagenicity indices associated with DAEs. Other countries require that DEAs have a mutagenicity index of less than 1.0. In the present invention system, the DAEs 16 are collected from the refinery 12 in the traditional manner. See Block 60. The DAEs 16 are introduced into a separate mixing tank 52. See Block 60. A solution of a ketone and a nitrile are introduced into the mixing tank 50. The preferred ketone is acetone 20 and the preferred nitrile is acetonitrile 50. The solution can range from a 2:1 ratio of acetone/acetonitrile to a 2:1 ratio of acetonitrile/acetone. The preferred solution being at or near 1:1. The solution is mixed with the DAEs at a concentration of approximately five parts acetone/acetonitrile solution to one part DAEs 16, by volume. See Block 62. The treatment process for DAEs 16 uses two solvents because DAEs 16 with high mutagenicity indices (e.g. 5 or more) tend to be completely soluble in acetone at ambient temperature. Therefore, it is necessary to increase the selectivity of mutagen removal by the addition of a more polar solvent to the extract. In the present case, the second solvent used is a nitrile, such as acetonitrile 50. When acetonitrile 50 is mixed with acetone 20 and the DAEs 16, some of the DAEs 16 settle to the bottom of the mixing tank 52 in a fashion analogous to that in the RAE processing previously described. The acetone/acetonitrile solution has been found to maximize the recovery of sellable oil, while avoiding significant reintroduction of mutagenic compounds.

In the mixing tank 52, the acetone/acetonitrile solution and the DAEs 16 form a mixture 54. Within the mixture 54, the acetone/acetonitrile solution dissolves mutagenic compounds within the DAEs 16 and/or alters the compounds to reduce mutagenicity. After mixing and allowing time for reactions, the mixture 54 is brought to rest and the DAEs 16 are allowed to settle to the bottom of the mixing tank. See Block 64. As the mixture 54 settles, much of the DAEs 16 separate from the acetone/acetonitrile solution. The settled DAEs are herein referred to as raffinate, or processed DAEs 56. The processed DAEs 56 settle to the bottom of the mixing tank 52 and are pumped away to a storage tank 58. See Block 66. The processed DAEs 56 have mutagenicity indices that are below the regulatory threshold. The processed DAEs 56 in the storage tank 58 are therefore ready for sale in any and all markets.

After the removal of the processed DAEs 56, the remaining solution 61 is isolated in the mixing tank 52. The remaining solution 61 is then heated to a temperature that is above the boiling point of the acetone 20 but well below the boiling point of both the acetonitrile 50 and the dissolved DAEs 16. See Block 68. This can be done by heating the mixing tank 52. However, in the illustrated system, the remaining solution 61 is pumped through a first evaporator 63. The acetone 20 vaporizes and is reclaimed by a first vapor reclaimer 65. The reclaimed acetone 20 is reused in subsequent runs. See Block 70.

The remaining solution is then pumped through a second evaporator 67. The remaining solution is then heated to a temperature that is above the boiling point of the acetonitrile 50 but well below the boiling point of the dissolved DAEs 16. See Block 72. The acetonitrile 50 vaporizes and is reclaimed by a second vapor reclaimer 69. See Block 74. The reclaimed acetonitrile 50 is reused in subsequent runs.

Once both the acetone 20 and the acetonitrile 50 are removed from the solution, a residuum 71 of precipitated DAEs remain. If economically viable, the residuum 71 can be further processed using traditional refinery hydroprocessing techniques. See Block 76 an Block 78. After hydroprocessing, many of the DAEs are recovered from the residuum 71 and can be mixed with the processed DAEs 56. It will be understood that the step of reworking the residuum 71 with hydroprocessing is optional and depends upon the volume of residuum 71 produced in a production run. After hydroprocessing, nearly all the usable DAEs 16 are recovered and meet the regulatory mutagenicity requirements.

Both the DAEs 16 and RAEs 14 processed by the present invention system and method retain the aromatic solvency characteristics required for efficacy in their end uses. Final recoveries of useable RAEs 14 are typically greater than 75%. Recoveries of DAEs 16 are inversely proportional to the mutagenicity index of the starting feedstock, and can be as low as 15%.

Extracts from both DAEs 16 and RAEs 14 can be converted into safe oils using much milder hydroprocessing than that needed for whole oil treatment. Hydroprocessing saturates especially susceptible to aromatic bonds in the extracted compounds, thereby reducing or eliminating their mutagenicity, while minimally affecting their desirable aromatic solvency properties. The hydroprocessed extracts can then be added back to their corresponding raffinates, resulting in a near quantitative recovery of usable oil.

It will be understood that the embodiment of the present invention that is illustrated and described is merely exemplary and that a person skilled in the art can make many variations to that embodiment. All such embodiments are intended to be included within the scope of the present invention as defined by the appended claims.

What is claimed is:

1. A method of reducing mutagen levels contained within petroleum aromatic extracts, said method comprising the steps of:

refining a petroleum oil, therein producing distillate aromatic extracts as a byproduct, said distillate aromatic extracts having a first level of mutagenic compounds;

mixing said distillate aromatic extracts with at least one solvent to produce a mixture, wherein said at least one solvent includes acetone and acetonitrile;

resting said mixture to enable some of said distillate aromatic extracts to settle;

removing said distillate aromatic extracts that have settled from said mixture, wherein said distillate aromatic extracts removed from said mixture have a second level of mutagenic compounds that is lower than said first level of mutagenic compounds.

2. The method according to claim 1, wherein removing said distillate aromatic extracts that have settled from said mixture leaves a residual solution, wherein said method further includes evaporating said at least one solvent from said residual solution.

3. The method according to claim 2, wherein evaporating said at least one solvent from said residual solution produces a residuum of aromatic extracts.

4. The method according to claim 3, further including hydroprocessing said residuum of aromatic extracts.

5. The method according to claim 1, wherein said distillate aromatic extracts are residual aromatic extracts and said mixture has a general ratio of five parts acetone to one part said residual aromatic extracts.

6. The method according to claim 1, wherein said at least one solvent contains acetone and acetonitrile in a ratio of between 1:2and 2:1.

7. A method of reducing mutagen levels contained within distillate aromatic extracts, said method comprising the steps of:

providing a volume of distillate aromatic extracts having a first level of mutagenic compounds;

mixing said distillate aromatic extracts with a solvent solution to produce a mixture, wherein said solvent solution includes acetone and acetonitrile;

resting said mixture to enable some of said distillate aromatic extracts to settle from said mixture;

removing said distillate aromatic extracts that have settled from said mixture, wherein said distillate aromatic extracts removed from said mixture have a second level of mutagenic compounds that is lower than said first level of mutagenic compounds.

8. The method according to claim 7, wherein removing said distillate aromatic extracts that have settled from said mixture leaves a residual solution, wherein said method further includes evaporating said acetone from said residual solution.

9. The method according to claim 8, further including recovering said acetone evaporated from said residual solution.

10. The method according to claim 7, wherein removing said distillate aromatic extracts that have settled from said mixture leaves a residual solution, wherein said method further includes evaporating said acetonitrile from said residual solution.

11. The method according to claim 10, further includes recovering said acetonitrile evaporated from said residual solution.

12. The method according to claim 7, further including evaporating said solvent solution from said mixture to produce a residuum of aromatic extracts.

13. The method according to claim 12, further including hydroprocessing said residuum of aromatic extracts.

14. The method according to claim 7, wherein said mixture has a general ratio of five parts said acetone to one part said residual aromatic extracts.

15. The method according to claim 7, wherein said solvent solution contains both acetone and acetonitrile in a ratio of between 1:2and 2:1.

16. A method of reducing mutagen levels contained within residual aromatic extracts, said method comprising the steps of:

providing a volume of residual aromatic extracts having a first level of mutagenic compounds;

mixing said residual aromatic extracts with acetone and acetonitrile to produce a mixture;

resting said mixture to enable some of said residual aromatic extracts to settle from said mixture;

removing said residual aromatic extracts that have settled from said mixture, wherein said residual aromatic extracts removed from said mixture have a second level of mutagenic compounds that is lower than said first level of mutagenic compounds.

17. The method according to claim 16, further including evaporating said acetone from said mixture.

18. The method according to claim 17, further including recovering said acetone evaporated from said mixture.

* * * * *